United States Patent [19]

Gondo et al.

[11] 4,016,740

[45] Apr. 12, 1977

[54] METHOD AND AN APPARATUS FOR THE MANUFACTURE OF A STEEL SHEET

[75] Inventors: Hisashi Gondo; Hiroshi Takechi; Tsuyoshi Kawano, all of Kisarazu; Hiroaki Masui; Kazuo Kovama, both of Kimitsu, all of Japan

[73] Assignee: Nippon Steel Corporation, Tokyo, Japan

[22] Filed: Aug. 22, 1975

[21] Appl. No.: 606,783

Related U.S. Application Data

[63] Continuation of Ser. No. 428,825, Dec. 27, 1973, abandoned.

[52] U.S. Cl. ..... 72/128; 148/12 C; 72/364

[51] Int. Cl.[2] ..... B21B 9/00

[58] Field of Search ..... 72/128, 364, 161; 148/12

[56] References Cited

UNITED STATES PATENTS

| | | | |
|---|---|---|---|
| 1,108,144 | 8/1914 | Daniels | 72/128 |
| 2,980,561 | 4/1961 | Ford et al. | 148/6.15 |
| 3,161,225 | 12/1964 | Ward et al. | 72/128 |
| 3,432,368 | 3/1969 | Nakamura | 148/12 |
| 3,806,376 | 4/1974 | Toda et al. | 148/12 |

FOREIGN PATENTS OR APPLICATIONS

| | | | |
|---|---|---|---|
| 915,178 | 1/1963 | United Kingdom | 72/128 |

*Primary Examiner*—Lowell A. Larson
*Attorney, Agent, or Firm*—Watson Leavenworth Kelton & Taggart

[57] ABSTRACT

A steel sheet, especially a thin one, can be manufactured from a hot rolled coil through heat treating steps by means of positively applying stress to the material. The product has excellent shape and mechanical properties such as drawability and toughness.

16 Claims, 12 Drawing Figures

($a_1$) cooled at about 20°C/min (corres. to normalizing)

($a_2$) cooled at more than 20°C/min down below $A_1$ point, followed by natural cooling ($a_3$) quenched FIG. 1a
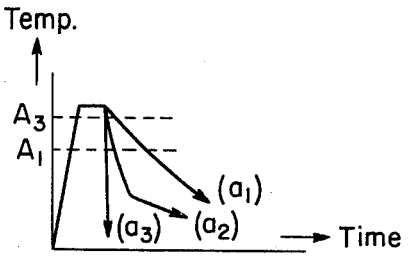
($a_1$) cooled at about 20°C/min (corres. to normalizing)
($a_2$) cooled at more than 20°C/min down below $A_1$ point, followed by natural cooling
($a_3$) quenched
FIG. 1b
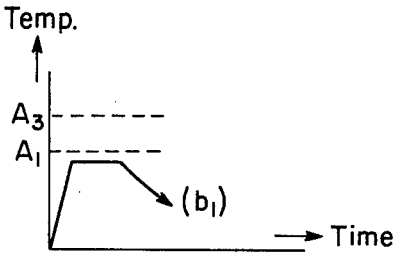
($b_1$) subjected to temper treatment
FIG. 1c
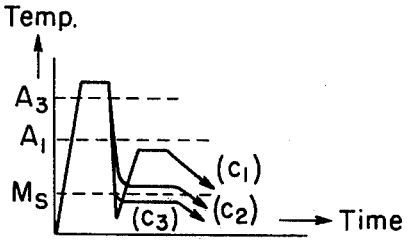
($c_1$) quenched and tempered
($c_2$) austempered
($c_3$) martempered
FIG. 1d
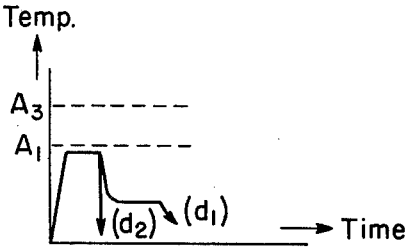
($d_1$) quenched at low temp.
($d_2$) quenched at low temp. with over-aging
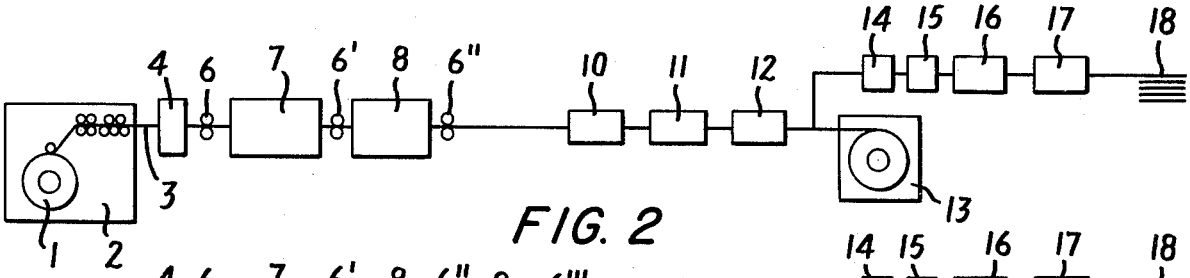
FIG. 2
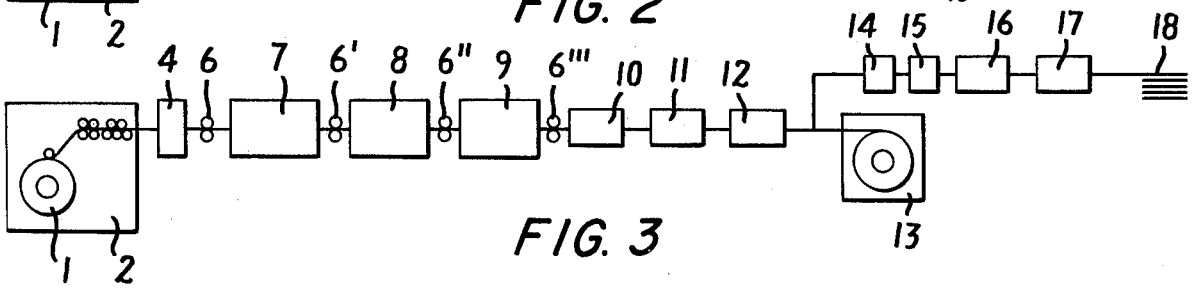
FIG. 3
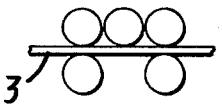
FIG. 4a
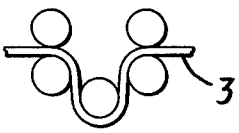
FIG. 4b

METHOD AND AN APPARATUS FOR THE MANUFACTURE OF A STEEL SHEET

This is a continuation of application Ser. No. 428,825, filed Dec. 27, 1973 now abandoned.

BACKGROUND OF THE INVENTION

The procedure for the manufacture of hot rolled steel sheet by means of a continuous hot rolling mill process has a much higher productivity than the procedure for the manufacture of thick steel plate. The steel sheet product obtained by the former procedure is also very excellent in the shape, dimensional accuracy and surface condition as compared with steel plate obtained by the latter procedure. Thus steel sheet manufactured by a continuous hot rolling mill amounts to as much as about 40% of the total hot rolled steel material and has wide applications in various field. For example, hot rolling has recently been used not only for 30 kg/mm$^2$ class steel but also for steel having high strength and good toughness. However, the finishing or coiling temperature of the hot rolling procedure which has a great effect upon the properties of hot rolled steel sheet cannot be significantly modified in view of manufacturing facilities with the result that the existing of the material as rolled and subject to undue properties unavoidable limitation. Accordingly, it has heretofore been a practice for accomplishing the above object to use an expensive alloy or, if necessary, conduct a controlled rolling. The steel sheet thus obtained, however, becomes very expensive and moreover gives rise to a considerable decrease in productivity due to the controlled rolling. The as-hot-rolled steel sheet also has the disadvantage of fluctuating in quality along the longitudinal length of the coil.

In addition to the production of as-hot-rolled steel sheet having high strength and good toughness, it has conventionally been practiced in the manufacturing procedure for a steel plate to effect such heat treatments such as quenching, tempering, normalizing, etc. After hot-rolling. In this procedure, however, the heat treatments are conducted with respect to a sheet material which has been cut to length, which thus results in a defect as to shape. Thus it has been reported that a product having a thickness up to 6mm can hardly be manufactured. Even if such a product can be manufactured, it is necessary to effect strong cold-straightening after the heat treatment, which results in a considerable deterioration in the material. Such problem also remains even in steel having a thickness of 6 to 10mm.

Conventionally, cold rolled steel sheet has been supplied as a steel sheet satisfying the requirements for deep drawing. In an attempt to contract the annealing and skin-pass rolling process for cold rolled steel sheet, it has recently been proposed to effect a continuous annealing process. However, it is often difficult in continuous annealing to obtain a desirable texture for deepdrawability due to the rapid heating, especially in the cases of Al-killed steel and rimmed or capped steel. Such cold rolled steels, when intended for deep drawing, must be subjected to further steel-making operations such as vacuum degassing, and the like.

As for hot rolled steel sheet, it has been a desideratum to develop such a sheet having drawability equivalent to that of cold rolled steel sheet or a hot rolled steel sheet having high strength with drawability. Also a demand for a very thin hot rolled steel sheet having a thickness not more than 1.6 mm is increasing year after year. In a conventional hot rolling mill, it is difficult to produce steel sheet having a thickness not more than 1.6 mm. The main reasons for this are that it is difficult to maintain the finishing temperature above the $A_3$ point for a drawing steel and to maintain a good shape for a high strength steel.

It is therefore an object of the invention to provide a method which is conducted upon a continuous heat treatment of hot rolled strip coil and wherein a stress is positively imparted.

It is another object of the invention to make it possible to conduct the heat treatment upon a thin material having a thickness up to 6 mm which has heretofore been impossible.

It is still another object of the invention to make it possible to manufacture hot rolled steel sheet or strip with a thickness not more than 1.6 mm having a good shape, high strength and good toughness.

It is a further object of the invention to provide a product of uniform quality along the entire length of the coil.

It is still a further object of the invention to provide a product of low cost as compared with the as-rolled high tensile strength steel in which a highly expensive alloy element must be used.

It is still a further object of the invention to make it possible to omit or lessen the controlled rolling of the material during the hot rolling.

It is still a further object of the invention to obtain a high strength and good toughness steel, which has never been manufactured, by means of controlled cooling after heating.

It is still a further object of the invention to make possible the manufacture of a drawing quality of cold rolled Al-killed, rimmed or capped steel sheet by continuous annealing by means of a preliminary heat treatment of hot coil.

It is still a further object of the invention to make possible the manufacture of quality of drawing hot rolled steel sheet which has not been obtained in the prior art.

SUMMARY OF THE INVENTION

This invention relates to a method and apparatus for manufacture of steel sheet having a excellent shape and quality, from hot rolled coil sujected to heat treatment by positively imparted stress during the continuous heat treatment of the hot rolled coil. The hot rolled coiled steel includes normal steel or low alloy steel with or without scale. It may be one cooled to room temperature or as coiled at high temperature. More particularly, the invention relates to a method and apparatus for the manufacture of such steel sheet or strip wherein the hot rolled coil is uncoiled by an uncoiler and then heated in a heating furnace capable of uniformly heating and holding at temperatures below 1300° c, and if necessary, rolled under a reduction of at least 3%, or forced cooled in cooling zone capable of cooling at a rate of at least 20° C/min. with or without subsequent reheating in a heating furnace capable of uniformly heating below about 1000° C, and in the mean time the stress is positively imparted to the strip. The strip is then passed through straightening units, and finally, coiled or cut to length for sheet.

According to this invention, there is provided a method for the manufacture of a steel sheet or strip subjected to the heat treatment which comprises a step of uncoiling the hot rolled coil, a step of heating said uncoiled strip at temperatures below 1300° C, a step of positively imparting a stress upon said uncoiled strip in said heating step, and a step of either coiling, or cutting to length, the same passed through said steps. According to this invention there is also provided a method for the manufacture of a steel sheet or strip subjected to the heat treatment which comprises a step of uncoiling the hot rolled coil, a step of heating said uncoiled strip at temperatures below 1300° C, a step of forced cooling at the cooling rate of at least 20° C/min., a step of positively imparting a stress upon said uncoiled strip in said heating step and/or said cooling step, and a step of either coiling, or cutting to length, the same passed through said steps.

According to this invention there is also provided a method for the manufacture of a steel sheet or strip subjected to the heat treatment which comprises a step of uncoiling the hot rolled coil, a step of heating said uncoiled strip at temperatures below 1300° C, a step of forced cooling the same at a cooling rate of at least 20° C/min., a step of reheating or holding said uncoiled strip at temperatures below 1000° C, a step of positively imparting a stress upon said uncoiled strip in any of the aforesaid heating, cooling or reheating steps, and a step of either coiling, or cutting to length, the same passed through said steps.

According to this invention there is also provided a method for the manufacture of a steel sheet or strip subjected to the heat treatment which comprises a step of uncoiling the hot rolled coil, a step of heating said uncoiled strip at temperatures below 1300° C, a step of hot- or warm-rolling said strip at the reduction of at least 3%, a step of positively imparting a stress upon said strip in the heating and/or rolling steps, and a step of either coiling, or cutting to length, the same passed through said steps.

According to this invention, there is also provided a method for the manufacture of a steel sheet or strip subjected to the heat treatment which comprises a step of uncoiling the hot rolled coil, a step of heating said uncoiled strip at temperatures below about 1300° C, a step of hot- or warm-rolling said strip at the reduction of at least 3%, a step of forced cooling said strip at the cooling rate of at least 20° C/min. and/or a step of reheating or soaking said strip at temperatures below about 1000° C. a step of positively imparting a stress upon said strip in any of said heating, rolling, cooling or reheating steps, and a step of either coiling, or cutting to length, the same passed through said steps.

According to this invention, there is also provided an apparatus for the manufacture of a steel sheet or strip subjected to the heat treatment which comprises, between an uncoiler for uncoiling the hot rolled coil and a coiler for coiling the strip or a piler for transporting the sheet cut from the strip, a non-oxidizing heating furnace and a stress-imparting means, and if necessary a rolling mill, a cooling zone for supplying a cooling medium between rolls or providing the rolls as the cooling medium, or a second heating furnace, said stress-imparting means being placed at any position back and forwards of said furnace, rolling mill or cooling zone, all said elements being arranged in a continuous manner.

This invention is applicable to both thin material and thick material, examples being given herein of material as thin as 1.2 mm and as thick as 12.7 mm being treated. It is, however, most suitable for thin material having a thickness of 6 mm or less.

BRIEF DESCRIPTION OF THE DRAWING

FIGS. 1*a–d* are graphs showing some examples of the heat cycles feasible in this invention.

FIGS. 2 and 3 and 5 to 8 are schematic views illustrating examples of this invention.

FIG. 4 is illustrative of the apparatus for imparting the stress to the material which is a bridle roll, and (a) is before bighting and (b) is after bighting the material.

DESCRIPTION OF THE PREFERRED EMBODIMENTS

Figure 5:
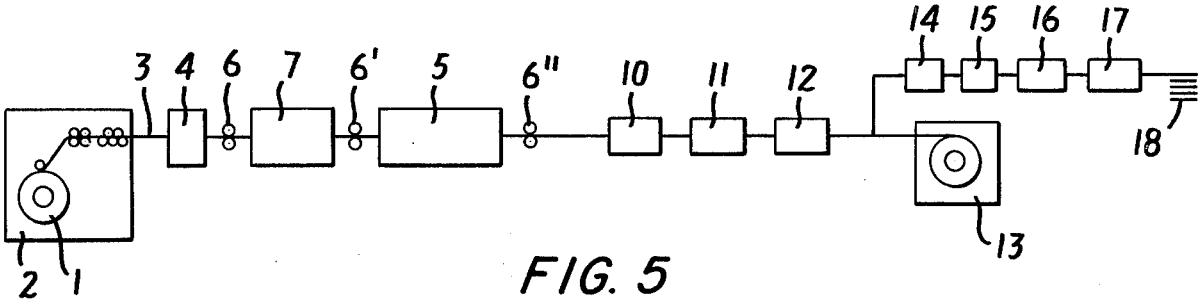

The steel sheet or strip manufactured by this invention varies widely. One example of the heating cycles possible in this invention is shown in FIG. 1. The heating cycles shown in (*a*) and (*b*) are conducted according to the apparatus shown in FIG. 2 by the provision of heating, cooling and stress-imparting. In the (*a*) cycle, the material is heated above the $A_3$ transformation point and then cooled as, for example by normalizing, quenching, tempering, etc. In this case a steel sheet having a good toughness and excellent cold workability can be produced by controlling the cooling condition after heating and by imparting a stress upon the material. The cycle (*b*) is typified by the tempering, the main application is the treatment for promoting precipitation for a valuable texture and tempering after rolling. In this case the material is usually heated between 400° C and the $A_1$ point but in this invention a stress is positively imparted and thus a better result is given in addition to a better shape for the product. The heating cycles shown in (*c*) and (*d*) are conducted according to the apparatus shown in FIG. 3 by the provision of heating, cooling, reheating or soaking and stress-imparting. The heating cycle shown in (*c*) is typified by the treatment in which the material is heated above the $A_3$ point, quenched below the $M_s$ point and then tempered, the martempering in which the material is soaked below the $M_s$ point and the austempering whereby the fine bainite transformation occurs. In cycle (*d*) is shown a special case in which the material is heated below the $A_1$ point or sometimes between the $A_1$ and $A_3$ point, then subjected to heat treatment such as quenching, quench--overaging etc. In any case, a stress is imparted positively so that an excellent product can be obtained.

In this invention, a stress is positively imparted upon the material in a continuous processing line. It can be done by tension, bending by a leveller, ultrasonic wave, mechanical vibration, etc.

For example, if the stress is imparted to the material by tension, the shape of the material improves and in addition, the forced cooling of the strip becomes more uniform whereby a uniform quality material can be obtained and also the manufacture of thermally refined steel having a thickness below 6 mm becomes possible, which has heretofore been impossible in view of the shape. At the same time the imparting of the tension enhances the adaptability for quenching which makes the uniform quenching possible. Also in the quenching and tempering treatment, the tension-imparting can produce tempered martensite having uniform and fine structure. In the rolling and normalizing process, the tension-imparting makes the structure of the steel much finer and stronger. Moreover, the stress-imparting in the preliminary treatment before cold rolling will make a completely precipitation treatment which effectively affects upon a promotion of the deep-drawability. Also th stress-imparting in the hot rolled steel sheet for deep drawing will promote a deep-drawability when applied during the recrystallization annealing.

When the tension is applied in the precipitation treatment, the precipitating is accelerated whereby not only the shape but also the quality is enhanced and the thermal refining is made perfect. The stress imparted may be, for example, a tension positively applied by a series of pinch rolls or their equivalents which results in the excellent shape of the material. In order to further promote the properties of the material such as strength, toughness, etc., it is preferable to impart a stress of at least about 1 kg/mm$^2$. Particularly when extremely height qualities are desired, it is preferable to impart a stress of at least about 3 kg/mm$^2$. By means of this stress-imparting, the excellent shape and quality of the material are obtained. In order to obtain improved result upon thin material, it is recommended to use a bridle roll as shown in FIG. 4, while for thick material, it is desirable to positively impart the stress by means of the uncoiler 2, hot leveller 10 or skinpass 12, etc. In addition to the tension, the stress can be applied by bending, mechanical vibration, ultrasonic wave, etc. However, the stress-imparting does not include the rolling work. The stress may be imparted at any place, for example, near the heating furnace, rolling mill or the cooling zone.

The upper limit of the temperature of the first heating furnace shown as reference numeral 7 in FIGS. 2, 3, and 5-8 is based upon the solution temperature of the steel. On the other hand, it is necessary to keep the temperature above the $A_3$ point in order to make uniform or strong the internal structure of the steel by the use of the phase transformation in the subsequent cooling step or the cooling and heating step. Usually the temperature used in the furnace is between the $A_3$ point and 1000° C. However, in order to dissolve certain precipitates by solid solution treatment, the temperature may sometimes be above 1100° C. Thus, the furnace should preferably be a nonoxidizing atmosphere heating furnace in which an inert gas is used for minimizing scale. However, if the temperature is above 1300° C, much scale is produced and in addition to a good quality material cannot be expected. In special cases, the first heating furnace is used to accelerate the precipitation of various added elements for the purpose of improving the quality of the steal. In these cases, the temperature should preferably be between 400° C and the $A_3$ point. In the rolling and normalizing process (FIGS. 5-8), the rolling and quench and temper (FIG. 7) or Q-T process (FIG. 3) and the process for making a very thin steel sheet (FIGS. 5-8), the temperature may be slightly above the $A_3$ point. A higher temperature than that will not result in any significant advantage. In the preliminary treatment before cold rolling or the warm-rolling treatment, the temperature used in below the $A_3$ point as mentioned above, for example, in the range between 200° C and 750° C. Thus the upper limit of the temperature used in the first heating furnace 7 is 1300° c.

The reason why the lower limit of the reduction for the rolling mill 5 in FIGS. 5-8 is 3% is as follows:

The lower limit is based upon the reduction of the warm-rolling for the preliminary treatment before cold rolling. The proper reduction for producing precipitates suitable for forming the recrystallization texture desirable for the deep-drawability after the cold rolling and annealing is between 3 and 25%. In the rolling and normalizing process (FIGS. 5-7) and the rolling and Q-T process (FIG. 7) the reduction of at least 3%, preferably at least 5%, is necessary for making the structure much finer and tougher. In the manufacture of hot rolled steel sheet or strip for deep drawing (FIG. 8), the rolling is effected at suitable temperature below the recrystallization temperature, and the reduction of at least 15% is necessary in order to obtain the recrystallization texture. In case of producing soft hot rolled steel sheet or strip, the reduction rate of 3 to 15% is necessary. Also, in case of very thin hot rolled steel sheet or strip, the reduction is at least 10%.

In the cooling one 8 in FIGS. 2, 3, 6 and 7, the steel strip may be cooled at a forced cooling rate of at least 20° C/min. to the desired temperature. In this case, it is usually necessary to cool the material below the $A_1$ point preferably at least 30° C/min., in order to make a fine structure and tough steel by virtue of the phase transformation. The cooling rate herein used indicates the lower limit of the cooling rate at any temperature during the forced cooling. In the case of thin material, the cooling rate of 20° C/min. can be accomplished by air cooling at room temperature. In this invention, however, a forced cooling rate more than that obtained by air cooling at room temperature is effected. In practice of the invention, quenching, can of course, be carried out. Accordingly, it is necessary to provide cooling capacity capable of cooling the material below the $M_s$ point at a cooling rate of at least about 10° C/sec., preferably at least about 40° C/sec. This cooling may preferably be done by supplying such a cooling medium as liquid, gas, etc., between the rolls, or by using the rolls as the cooling medium. In order to secure the shape of the steel strip, it is preferable in the cooling zone to pinch the steel strip between the upper and the lower group of rolls so as to secure the shape of the steel strip. It is also effective to effect cooling while conducting the bending of the material.

Figure 7:
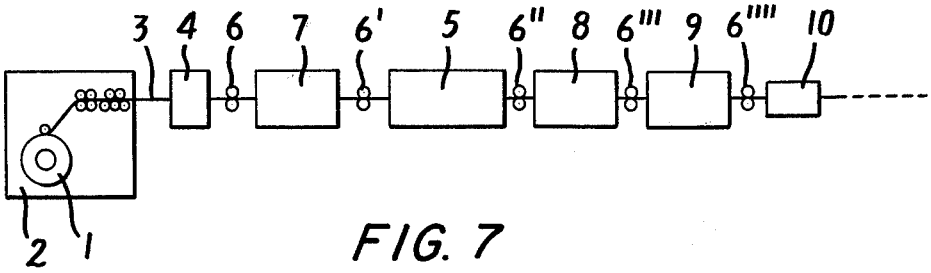
Figure 8:
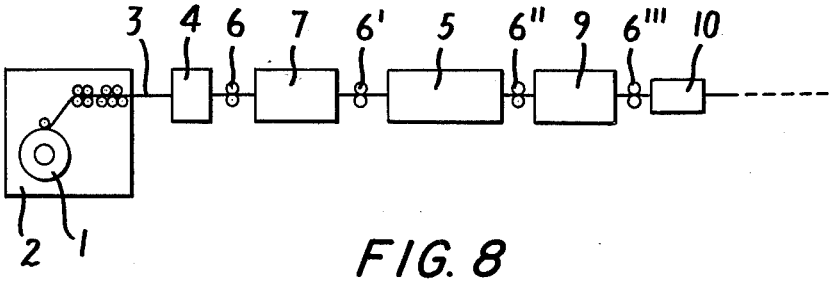

In second heating furnace as shown in FIG. 3, 7 and 8 as numeral 9, treatments such as tempering after quenching, austempering, martempering, and recrystallization annealing in warm-rolling for manufacture of hot-rolled steel sheet or strip for drawing etc., are illustrated. The temperature maintained in this furnace may usually be between 200° C and the $A_3$ point. In special cases, however, heating above the $A_3$ point is required for conducting repeated transformations for manufacture of steel having uniform and fine grain size. Generally, a temperature below 1000° C is necessary in this furnace for elevating and soaking the heat of the material.

The above stated heating furnace and the cooling zone may be a horizontal type for treating thin material or thick material. The hot rolling or warm-rolling may be conducted by at least one rolling mill such as a four-high mill or Sendzimir mill, etc., but the number of such mills should preferably be five or less for the sake of economy and for securing the desired temperature. In order to conduct the heat treatment on several hot rolled coils continuously, a looper, shear, welding machine, etc., may be positioned before the descaling means or between the uncoiler 2 and the descaling means 4.

The steel sheet conveying table may also be positioned before descaling means 4, or a slitter may be positioned before coiler 13.

In FIG. 2 is shown one example of the invention. The coil 1 which has been rolled by the hot continuous hot rolling mill is uncoiled by the uncoiler 2. The flat steel strip 3 is, if necessary, descaled by descaling means 4 such as shot blast or brushing roll, etc. Said steel strip is then heated to a desired temperature in the horizontal type non-oxidizing heating furnace 7 capable of heating and holding the temperature below 1300 C. Then, the material is cooled to a desired temperature at a desired cooling rate in the horizontal type cooling zone 8. Thereafter the strip is, if necessary, passed through the hot leveller 10 or the skinpass roll 12 and finally coiled at the coiler 13. When it is desired to produce a product such as sheet cut to length, the strip may be passed from the leveller 10 or the skinpass roll 12 to the side-trimmer 14 and the flying shear 15 where it is cut to a predetermined size. If necessary, it is further straightened by the cold leveller 16, passed to the check table 17 where the surface of the sheet is checked and then transported to piler 18. The numeral 11 shows strip-cooling means capable of effecting forcible cooling or mist cooling which is used for lowering the temperature of the strip below 500° C in order to make uniform the quality of the entire length of the coil when coiled. When the sheet is produced, the cooling means also serves to lessen or omit the cooling place for the sheet. Said cooling means 11 can of course be omitted when it is not necessary.

In the example shown in FIG. 3, there is provided a second horizontal type heating furnace 9, in addition to the cooling zone 8, in which the strip can be reheated or held at temperatures below 1000° C. After being passed through the subsequent shape-correction means, a strip is coiled or cut to the sheet of desired length. By provision of such second furnace 9 after the cooling zone 8, the heat treatments shown in FIG. 1 (*c*) and (*d*) are made possible and the quality of the product obtained may vary throughout a wide range. Consequently, it is preferable in this invention to provide this second furnace 9 backward of the cooling zone.

The stress-imparting means is, in the examples of FIGS. 2, 3 and 5-8 a series of pinch rolls 6, 6′, 6″ and 6‴ which positively impart tension to the strip.

EXAMPLE 1

The material used was hot rolled coil having a thickness of 6 mm and the chemical composition as shown in Table 1. The apparatus shown in FIG. 2 was used and the material was subjected to the heat treatment shown in Table 2. The mechanical property and the shape of the product are also shown in Table 2.

The wave degree in the table is the ratio of *h* to *l* in which h is the height of the wave of the product and *l* is the wave length. The smaller the ratio *h/l* is, the better the shape of the product is.

The hot rolled coil shown in Table 1 was heated above the $A_3$ point in the heating furnace 7, then subjected to rapid cooling in the cooling zone 8 at the rate of about 1° C/sec. down to 500° C (B), and about 4° C/sec. down to 500° C (C and D) by supplying water sprayed from above and below between the rolls and then allowed to cool in air. The stress-imparting during the heat treatment was done by a tension of about 1 kg/mm² by combination of pinch rolls 6, 6′, 6″ and the bridle roll in B and C case, and by a tension of about 3 kg/mm² by combination of the pinch rolls and the uncoiler and the hot leveller in D case. As obvious from Table 2, the product obtained according to this invention is much more excellent with respect to the shape than the conventional cut sheet subjected to the heat treatment and much stronger and tougher than the conventional as-rolled material. It is also obvious that the shape and the quality of the product are both improved by positively imparting the stress to the material.

Table 1

| C% | Si | Mn | P | S | Total Al | Thickness |
|---|---|---|---|---|---|---|
| 0.15 | 0.48 | 1.40 | 0.02 | 0.015 | 0.035 | 6.0 mm |

Table 2

| | | Condition for heat treatment | Stress imparted during heat treatment | Mechanical property: Yield point (kg/mm²) | Mechanical property: Tensile strength (kg/mm²) | Mechanical property: Elongation (%) | Toughness (JIS No. 4): vEo (kg-m/cm²) | Toughness (JIS No. 4): vTrs (° C) | Shape: Wave degree (h/l) |
|---|---|---|---|---|---|---|---|---|---|
| Comparative method | A | As-rolled | None | 39.4 | 55.1 | 34 | 14.7 | −62 | 0.8% |
| | B | 900° C × 5 min. (1° C/sec.) → 500° C → air cooling | Pinch roll plus bridle roll | 40.5 | 55.7 | 35 | 18.6 | ≤ −80 | ≤0.5 |
| Method of this invention | C | 900° C × 5 min. (4° C/sec.) → 500° C → air cooling | " | 41.3 | 57.3 | 33.5 | 20.1 | ≤ −80 | ≤0.5 |
| | D | Same as C | Pinch roll plus uncoiler and hot leveller | 41.5 | 57.6 | 34 | 21.4 | ≤−80 | ≤0.3 |

Remarks: Sheet subjected to usual normalizing (6.0 mm), Wave degree found ≤1.5%

EXAMPLE 2

The material used was a hot rolled coil having a thickness of 12.7 mm and 3.0 mm and the chemical composition shown n Table 3. The apparatus shown in FIG. 2 was used and the heat treatment was effected according to Tables 4 and 5. The mechanical properties and the shapes of the product obtained are also shown in Tables 4 and 5. In the material A, it was heated above the $A_3$ point and then cooled down to 400° C at the rate (F) of about 30° C/min. and (G) of about 5° C/sec., followed by air cooling. In the material B, it was heated above the $A_3$ point and then cooled down to 500° C at a rate of about 1.5° C/sec., followed by air cooling (I). The stress of about 1 kg/mm² was imparted in (I) by the pinch roll and in (F and G) by the uncoiler and hot leveller. As is obvious from Table 4, the sheet manufactured from the Al-killed steel (A) according to this invention has a excellent shape and improved strength, toughness and ductility while the sheet from the rimmed steel (B) has an excellent shape and cold workability as shown in Table 5.

Table 3

| Material | C% | Si | Mn | P | S | Total Al | Thickness |
|---|---|---|---|---|---|---|---|
| A | 0.18 | 0.38 | 1.32 | 0.018 | 0.018 | 0.024 | 12.7 mm |
| B | 0.13 | 0.01 | 0.46 | 0.017 | 0.022 | 0.003 | 3.0 |

Table 4 (Material A)

| | | Condition for heat treatment | Stress imparted during heat treatment | Mechanical property: Yield point (kg/mm²) | Mechanical property: Tensile strength (kg/mm²) | Mechanical property: Elongation (%) | Toughness (JIS No.4): vEo (kg-m/cm²) | Toughness (JIS No.4): vTrs (° C) | Shape: Wave degree (h/l) |
|---|---|---|---|---|---|---|---|---|---|
| Comparative method | E | As-rolled | None | 36.7 | 55.2 | 36 | 10.4 | −12 | 0.4% |
| Method of this invention | F | 870° C × 5 min. (30° C/min.) → 400° C → air cooling | Tension by uncoiler and hot leveller | 36.4 | 55.5 | 37 | 15.4 | −27 | ≤0.2 |
| | G | 870° C × 5 min. (5° C/sec.) → 400° C → air cooling | Same as above | 40.1 | 57.9 | 36 | 17.1 | −40 | ≤0.2 |

Remarks: Sheet subjected to usual normalizing (12.7 mm), Wave degree found ≤0.5

Table 5 (Material B)

| | | Condition of heat treatment | Stress imparted during heat treatment | Mechanical property: Yield point (kg/mm²) | Mechanical property: Tensile strength (kg/mm²) | Mechanical property: Elongation (%) | n value | Shape: Wave degree (h/l) |
|---|---|---|---|---|---|---|---|---|
| Comparative method | H | As-rolled | None | 26.1 | 39.2 | 44.8 | 0.22 | 0.9% |
| Method of this invention | I | 950° C × 5 min. (1.5° C/sec.) → 500° C → air cooling | Tension by pinch roll | 19.3 | 34.2 | 49.6 | 0.29 | ≤0.5 |

Remarks: Sheet subjected to usual normalizing (3.0 mm), Wave degree found ≤2.0%

EXAMPLE 3

The material used was a hot rolled coil having a thickness of 6.0 mm and the chemical composition shown in Table 6. The apparatus shown in FIG. 3 was used wherein the heat treatment according to Table 7 was conducted. The mechanical property and the shape of the product obtained are also shown in Table 7.

The material coil was heated in the first heating furnace 7 above the $A_3$ point and then quenched in the cooling zone 8 at a rate of about 200° C/sec. and subjected to the tempering treatment in the second furnace 9 at 670° C for 5 minutes A tension stress of about 1 kg/mm² was imparted by the pinch roll and the bridle roll in (K) and the tension stress of about 5 kg/mm² was imparted during the tempering treatment in (L). As shown in Table 7, the steel sheet obtained according to this invention is excellent with respect to both shape and quality.

Table 6

| C% | Si | Mn | P | S | Total Al | B | Ti | Thickness |
|---|---|---|---|---|---|---|---|---|
| 0.13 | 0.26 | 1.29 | 0.018 | 0.009 | 0.035 | 0.001 | 0.02 | 6.0 mm |

Table 7

| | | Condition of heat treatment) | Stress imparted during heat treatment) | Mechanical Property | | | Toughness (JIS No. 4) | | Shape |
|---|---|---|---|---|---|---|---|---|---|
| | | | | Yield strength (kg/mm²) | Tensile strength (kg/mm²) | Elongation (%) | vEo (kg-m/cm²) | vTrs (° C) | Wave degree (h/l) |
| Comparative method | J | As-rolled | None | 43.4 | 58.0 | 32 | 12.8 | −53 | 0.7 |
| Method of this invention | K | 910° C × 5 min. (200° C/sec.) → quench → 670° C × 5 min. → air cooling | Tension by pinch roll and bridle roll | 76.2 | 84.7 | 22 | 15.4 | ≤−80 | ≤0.5 |
| | L | Same as above | Tension 5kg/mm² during tampar | 78.6 | 87.1 | 21 | 18.7 | ≤−80 | |

Remarks: Sheet subjected to usual normalizing (6.0 mm), Wave degree found ≤1.5%

In the example shown in FIG. 5, the hot rolled coil 1 from the hot continuous rolling mill was uncoiled by the uncoiler 2 and the flat steel strip 3 obtained is, if necessary, descaled by means of such descaling means 4 such as shot blast or a brushing roll, etc. In this case, said hot rolled coil may be one cooled to room temperature or one as coiled at high temperature. After descaling, the strip is heated to the desired temperature in the horizontal type non-oxidizing heating furnace 7 capable of elevating and holding the temperature of the strip at a temperature below 1300° C. Then the strip 3 is warm-rolled or hot-rolled by one or more rolling mills 5 at the total reduction of 3% or more. Thereafter, if necessary, the strip is passed through the shape correcting means such as the hot leveller 10 or skinpass roll 12, or a cooling means 11 and coiled by the coiler 13. When the cut sheet is desired, the strip passed through the mill 5 or the skinpass roll 12 is cut to a predetermined length in the side trimmer 14 and the shear 15, then rectified in the shape-rectifying means such as the cold leveller 16 and checked in the surface-checking table 17, if necessary, and finally transported to the piler 18.

Figure 6:
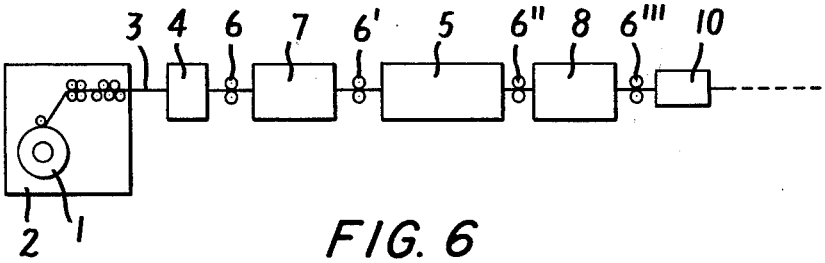

In the example shown in FIG. 6, the horizontal cooling zone 8 s positioned subsequent to the rolling mill 5, where the strip is cooled at the rate of at least 20° C/min. Thereafter, the strip is passed through the shape-rectifying means to the coiler or to the means capable of cutting the strip into sheet. In the example shown in FIG. 7 the horizontal heating furnace 9 is positioned subsequent to the cooling zone 8, where the temperature of the strip can be elevated or held at a temperature below 1000° C. As shown in FIG. 7, if the first heating furnace, the rolling mill, the cooling zone and the second heating furnace are positioned in a continuous manner, every heat treatment which is possible in the apparatus shown in FIGS. 2, 3, 5, 6 and 8 can be effected. The manufacture of the cold rolled steel sheet for deep-drawing according to the continuous annealing is made possible by the preliminary treatment before cold rolling according to the invention and it can be done in the apparatus shown in FIG. 8. When it is desired to make the cold rolled steel sheet for deep drawing by the continuous annealing process, it is difficult in the continuous annealing process requiring rapid heating and short holding to expect the fine precipitates which are effective for forming the recrystallization texture desirable for the deepdrawability. It is thus necessary to have such effective precipitates appear in the step of the hot rolled sheet. For this purpose, it is very effective to conduct a warm-rolling of 3 to 25%, preferably 5 to 20%, upon the hot rolled coil at about 500° to 750° C and then, if necessary, soak the same at temperatures between about 500° C and 750° C. Moreover, the precipitation treatment becomes complete by imparting the stress positively in said step.

In addition, the manufacture of hot rolled sheet having a thickness of 1.6 mm or less, which has heretofore been difficult in view of the shape and the insufficient finishing temperature of hot rolling, is made possible according to this invention by using the apparatus of FIGS. 5, 6 and 7 and by positively imparting the stress. That is, thin hot rolled steel sheet is manufacturd by means of the continuous hot rolling means, which sheet is then heated above the $A_3$ point in the non-oxidizing furnace 7 and hot-rolled to the predetermined thickness, followed by natural cooling or controlled cooling in the subsequent cooling zone 8 or the second heating furnace 9 as shown in FIGS. 5, 6 and 7, so that hot rolled sheet having a thickness of 1.6 mm or less as well as good shape may be obtained. In this case, the hot rolling reduction will depend upon the thickness of the product to be obtained and the thickness of the material manufactured by the continuous hot rolling mill. It may usually be at least 10%, preferably at least 20%.

According to this invention, the rolling and normalizing process can be effectively conducted, whereby good toughness steel can be obtained. In this case, the apparatus shown in FIGS. 5, 6 or 7 is used. This heat treatment involves heating the material above the $A_3$ point, adding mechanical work thereupon and then cooling the same below the $A_1$ point, whereby a structure which is finer and more uniform is attained. Therefore, a high tensile strength steel having good shape can thus be obtained. When the apparatus of FIGS. 6 and 7 is used, the toughness of the material may be promoted by controlling the cooling rate after rolling. When the apparatus of FIG. 7 is used, the fine and high tensile strength steel can be obtained according to the repeated phase transformation by reheating the material above the $A_3$ point after cooling.

In the rolling and QT process for obtaining the high strength and good toughness steel may be conducted according to this invention, for example, in the apparatus of FIG. 7. In this process, the material is heated above the $A_3$ point, added with mechanical work, quenched below the $M_s$ point and then tempered. The structure thus obtained has finer and more uniform martensite structure than that obtained by the conventional QT process, which makes it possible to obtain steel sheet having higher strength and better toughness with better shape. In special cases, the temper treatment can be omitted, and even only quenching after rolling without tempering will produce a high tensile strength and good toughness steel. In this unique rolling and normalizing process and rolling and QT process, the reduction should be at least 3%, preferably at least 5%. In these processes, the positive imparting of the stress will make the shape better and the structure finer and tougher.

The warm-rolling process for manufacturing the hot-rolled steel sheet or strip for drawing which has not been effected in the prior art can be done according to this invention by the use of the apparatus of FIG. 8. The main point for the manufacture of the hot rolled steel sheet or strip for drawing lies in that when the rolling is effected at temperatures between 200° C and the recrystallization temperature of the steel; the texture similar to that obtained by the cold rolling is obtained. After warm-rolling, steel strip is reheated and there is effected recrystallization annealing whereby the hot rolled strip or sheet having the same drawability as that of the cold rolled steel sheet can be obtained. In this case, the reduction by warm-rolling should be at least 15%, preferably at least 20%. The stressimparting during the heating treatment is effective for improving the drawability of the product.

Moreover, it is possible by suitable combination of heating, rolling, and stress to control the texture so as to be adapted for the use other than use for drawability. In special cases, it is possible in this invention to manufacture soft hot rolled steel sheet or strip by effecting a warm-rolling of 3% to 5% below the recrystallization temperature and then heating the same above the recrystallization temperature so that the extremely coarse grain structure may be obtained.

EXAMPLE 4 (the preliminary treatment before cold rolling)

The material used was a hot rolled coil having the thickness and the chemical composition shown in Table 8. The apparatus shown in FIG. 8 was used and the preliminary treatment before cold rolling as shown in Table 9 was effected. The product was coiled and thereafter subjected to the ordinary cold rolling and annealing according to Table 9.

Table 8

| C% | Si | Mn | P | S | sol. Al | N | Finishing Temp. | Coiling Temp. | Thickness |
|---|---|---|---|---|---|---|---|---|---|
| 0.04 | 0.01 | 0.32 | 0.017 | 0.010 | 0.042 | 0.0055 | 890° C | 350° C | 2.7 mm |

Table 9

| | | Preliminary treatment before cold rolling | | | | | Cold rolled sheet | |
|---|---|---|---|---|---|---|---|---|
| | | Warm Rolling | Preservation of Heat | Stress Imparting | Cold Reduction | Annealing Condition | Conical cup value | Erichsen value |
| Method of this Invention | A | 10% at 600° C | 600° C × 10 min. | About 3kg/mm² | 70% | 800° C × 2 min. + 350° C × 5 min. | 35.2 mm | 11.2 mm |
| Comparative Method | $A_2$ | " | " | None | " | | 35.7 | 10.9 |
| " | $A_3$ | | none | " | " | | 37.0 | 10.4 |
| " | $A_4$ | | none | " | " | 700° C × 4 hr. | 36.0 | 10.8 |

In $A_1$ of this invention, the material was heated in the non-oxidizing heating furnace 7° to 600° C and thereafter rolled by 10% in the rolling mill 5 and preserved in th second heating furnace *g* at 600° C x 10 minutes, while in the preliminary treating step before cold rolling, the stress of about 3 kg/mm² was imparted. In A2 of the comparative method, the stress was not imparted while in A3 and A4 the preliminary treatment before cold rolling was not conducted.

These coils obtained were subjected to the pickling, the cold rolling of 70% and the continuous annealing (box annealing in A4). The property of the cold rolled steel sheet is shown in FIG. 9 wherein the conical cup value shows the drawability and the Erichsen value shows the flanging ability. The less the conical cup value is, the better the drawability is. The more the Erichsen value is, the better the flanging ability is.

It is obvious from Table 9 that the cold rolled steel sheet of this invention is much better than that of the comparative method with respect to both the drawability and the flanging ability.

EXAMPLE 5 (Manufacture of very thin hot rolled steel sheet)

The material used was the hot coil having a thickness and the chemical composition shown in Table 10. The very thin hot rolled steel sheet (0.9 mm) was manufactured according to the Table 11 by the use of the apparatus of FIG. 7. The property of the sheet including its wave degree are shown in Table 11.

The heating shown in Table 11 was conducted in the non-oxidizing heating furnace 7 of FIG. 7 and the stress imparted was the tension of 1kg/mm² by the pinch rolls 6 to 6''''. As seen from Table 11, it is obvious that the B1 of this invention shows improved elongation and Rankford value as well as excellent shape as compared with the B2 and B3 of the comparative method.

Table 10

| C% | Si | Mn | P | S | Thickness | Finishing Temp. | Coiling Temp. |
|---|---|---|---|---|---|---|---|
| 0.04 | 0.02 | 0.29 | 0.016 | 0.013 | 1.2 mm | 820° C | 600° C |

Table 11

| | | Condition of treatment | | | | | | Mechanical property | | | | Shape |
|---|---|---|---|---|---|---|---|---|---|---|---|---|
| | | Heating temp. | Hot reduction | Cooling rate | Preserving temp. | Stress-imparting | Thickness (mm) | YP | TS | El | r value | Wave degree |
| Method of this invention | B1 | 1000° C | 25% | 30° C /sec. | 600° C × 5min. | By pinch roll | 0.9 | 21.3 | 32.6 | 47 | 0.95 | ≤0.2 |
| | B2 | " | " | " | " | None | 0.9 | 21.0 | 32.5 | 45 | 0.90 | ≤0.5 |
| Comparative method | B3 | As rolled | | | | | 1.2 | 20.1 | 31.2 | 40 | 0.69 | 1.5 |

EXAMPLE 6 (Rolling and normalizing process)

The material used was a hot rolled coil having the thickness and the chemical condition shown in Table 12. The rolling and normalizing process was conducted using the apparatus of FIG. 6 according to the treatment shown in Table 13.

Table 12

| C% | Si | Mn | P | S | Al | Thickness |
|---|---|---|---|---|---|---|
| 0.14 | 0.35 | 1.31 | 0.010 | 0.010 | 0.034 | 6 mm |

Table 13

| | | Condition of treatment | | | | Mechanical property | | | Toughness (JIS No.4) | | Shape |
|---|---|---|---|---|---|---|---|---|---|---|---|
| | | Heating temp. | Hot reduction | Cooling condition | Stress-imparting | YP | TS | El | vEo | vTrs | Wave degree |
| Method of this invention | C1 | 950° C | 15% | 870° C (at 4° C/sec.) → 500° C → air cooling | By bridle roll | 44.6 | 58.8 | 32.5 | 23.1 | ≤−80 | ≤0.2 |
| Comparative method | C2 | " | " | " | None | 43.7 | 57.3 | 33.5 | 20.5 | ≤−80 | ≤0.5 |
| " | C3 | | | As-rolled | | 38.8 | 53.4 | 35 | 13.7 | −58 | ≤0.8 |

The methods C1 and C2 in Table 13 were conducted by heating the material in the heating furnace 7 at 950° C for 5 minutes, rolling at 870° C by 15% and cooling to 500° C at about 4° C/sec., followed by air cooling. In addition, the tension of 1 kg/mm² was imparted by the use of the bridle roll in the method of the C1. It is demonstrated that the method of this invention as represented by the C1 gives a prominent advantage in the quality of the product, particularly in the toughness as well as in the shape.

EXAMPLE 7 (Rolling and QT process)

The material used was a hot rolled coil having the thickness and the chemical composition shown in Table 14. The rolling and QT process was conducted using the apparatus of FIG. 7 according to the treatment of Table 15.

In the D1 and D2, the heating and reheating were conducted in the non-oxidizing heating furnace 7 and the second heating furnace 9. In the D1, the tension of about 1 kg/mm² mm was imparted by the bridle roll. As seen from Table 15, the rolling and QT process according to this invention involving the rolling and stress-imparting in addition to the conventional QT process shows a remarkable improvement in the toughness and the shape.

Table 14

| C% | Si | Mn | P | S | Al | B | Ti | Thickness |
|---|---|---|---|---|---|---|---|---|
| 0.13 | 0.26 | 1.29 | 0.018 | 0.009 | 0.035 | 0.001 | 0.02 | 6.0 mm |

Table 15

| | Condition of treatment | | | | | Mechanical property | | | Toughness (JIS No.4) | | Shape |
|---|---|---|---|---|---|---|---|---|---|---|---|
| | Heating temp. | Hot reduction | Cooling | Reheating | Stress-imparting | YP | TS | El | vEo | vTrs | Wave degree |
| Method | | | | 670° C × | By | | | | | | |

Table 15-continued

| | | Condition of treatment | | | | | Mechanical property | | | Toughness (JIS No.4) | | Shape |
|---|---|---|---|---|---|---|---|---|---|---|---|---|
| | | Heating temp. | Hot reduction | Cooling | Reheating | Stress-imparting | YP | TS | El | vEo | vTrs | Wave degree |
| of this invention | D1 | 910° C | 10% | 850° C → room temp. (200° C /sec.) | 5 min. | bridle roll | 77.3 | 85.7 | 22 | 24.3 | ≤−80 | ≤0.2% |
| Comparative method | D2 | 910° C | 10% | | " | None | 77.0 | 85.1 | 22 | 20.1 | ≤−80 | ≤0.5 |
| " | D3 | | | As-rolled | | | 43.4 | 58.0 | 32 | 12.8 | −53 | 0.7 |

EXAMPLE 8 (Warm rolling process)

The material used was a hot rolled coil having the thickness, the chemical composition and the hot rolling condition shown in Table 16. The property of the steel sheet obtained by the treatment according to Table 17 using the apparatus of FIG. 8 is shown in Table 17.

The heating and reheating in the E1 and E2 were conducted in the heating furnaces 7 and 9. In the E1, the tension of about 3 kg/mm² was imparted by the bridle roll in the second heating furnace when the reheating was conducted. The quality of the product obtained according to this invention was quite excellent with respect to the drawability represented by the r value as well as the shape represented by the wave degree.

Table 16

| C% | Si | Mn | P | S | Al | Ti | Thickness | Finishing temp. | Coiling temp. |
|---|---|---|---|---|---|---|---|---|---|
| 0.004 | 0.02 | 0.16 | 0.019 | 0.008 | 0.035 | 0.08 | 3.2 mm | 910° C | 600° C |

Table 17

| | | Condition treatment | | | | Mechanical property | | | | Shape |
|---|---|---|---|---|---|---|---|---|---|---|
| | | Warm rolling | Reheating | Stress-imparting | Thickness | YP | TS | El | r value | Wave degree |
| Method of this invention | E1 | At 600° C 30% | 850° C × 5 min. | About 3 kg/mm² tension | 2.2 mm | 16.7 | 29.8 | 53 | 1.41 | ≤ 0.2 |
| Comparative method | E2 | " | " | None | 2.2 | 18.3 | 30.1 | 50 | 1.28 | ≤ 0.5 |
| " | E3 | | As-rolled | | 3.2 | 19.4 | 30.8 | 48 | 0.85 | 1.5 |

Remarks: El (Elongation) is the value calculated on thickness of 3.2 mm by the Oliver formula.

Example 9 (Manufacture of thin, high tensile strength hot rolled steel)

The material used was a hot rolled coil having the chemical composition and the thickness shown in Table 18. The quality of the product obtained by using the apparatus of FIG. 3 under the condition of Table 19 is shown in Table 19.

The hot rolled coil shown in Table 18 was heated above $A_3$ point in the furnace 7 at 850° C for 3 minutes. Then it was cooled in the cooling zone 8 at 5° C/sec. Thereafter it was subjected to the over-aging treatment in the furnace 9 at 450° C for 5 minutes. The tension of about 1 kg/mm² was imparted by the pinch roll. As shown in Table 19, the steel sheet obtained according to this invention was excellent with respect to both the shape and the quality than that which has not been given the stress.

Table 18

| C% | Si | Mn | P | S | T.Al | Ti | Ni | Cu | Thickness |
|---|---|---|---|---|---|---|---|---|---|
| 0.09 | 0.52 | 1.54 | 0.014 | 0.012 | 0.034 | 0.24 | 0.15 | 0.04 | 1.6 mm |

Table 19

| | | Condition of heat treatment | Stress imparted | Mechanical property YP | TS | El | Ericksen value | Shape Wave degree |
|---|---|---|---|---|---|---|---|---|
| Comparative method | F1 | As rolled | None | 72.3 | 82.6 | 16 | 8.4 | 0.7 |
| | F2 | 850° C × 3 min. 5° C/sec. cooling 450° C × 5 min. air cooling | None | 54.6 | 70.2 | 23 | 10.0 | ≤ 0.5 |
| | | | Tension by | | | | | |

Table 19-continued

| | | Condition of heat treatment | Stress imparted | Mechanical property YP | TS | El | Ericksen value | Shape Wave degree |
|---|---|---|---|---|---|---|---|---|
| Method of this invention | F3 | " | pinch roll of about 1 kg/mm² | 55.4 | 70.4 | 25 | 10.2 | ≤ 0.5 |

EXAMPLE 10 (Manufacture of thin, high tensile strength hot rolled steel) The material used was a hot rolled coil having the chemical composition and the thickness shown in Table 20. The heat treatment under the condition of Table 21 was effect by the apparatus shown in FIG. 6. The quality and the shape of the product are shown in Table 21.

The hot rolled coil shown in Table 20 was heated in the first heating furnace 7 at 1250° C for 30 minutes, rolled by 20% in the rolling mill 5, cooled in the cooling zone 8 at 20° C/sec. to the room temperature. The tension by the pinch roll of about 1 kg/mm² was given. As shown in Table 21, the steel sheet according to this invention was excellent with respect to both the quality and the shape as compared with that which has not been given the stress.

Table 20

| C% | Si | Mn | P | S | T.Al | Ti | Ni | Cu | Thickness |
|---|---|---|---|---|---|---|---|---|---|
| 0.09 | 0.52 | 1.54 | 0.014 | 0.012 | 0.034 | 0.24 | 0.15 | 0.04 | 1.6 |

Table 21

| | | Condition of heat treatment | Stress imparted | Mechanical property YP | TS | El | Ericksen value | Shape Wave degree |
|---|---|---|---|---|---|---|---|---|
| Comparative method | G1 | As rolled | None | 72.3 | 82.6 | 16 | 8.4 | 0.7 |
| " | G2 | 1250° C × 30 min. → 20% rolling finish temp. 850° C → 20° C/sec. → room temp. | None | 62.4 | 76.2 | 19 | 9.5 | ≤0.5 |
| Method of this invention | G3 | " | Tension by pinch roll of about 1 kg/mm² | 62.1 | 75.4 | 21 | 9.8 | ≤0.5 |

We claim:

1. A method for the manufacture of a steel sheet, steel strip and the like subjected to a heat treatment from a hot rolled coil, said sheet having a thickness of as low as 1.2 mm and as high as 12.7 mm which comprises uncoiling the hot rolled coil, heating said uncoiled strip at temperatures below 1300° C., subjecting the same to a forced cooling down to temperatures below the $A_1$ point at a cooling rate of at least 20° C/min., and positively imparting a stress upon said strip during the heat treatment.

2. A method for the manufacture of a steel sheet, steel strip and the like subjected to a heat treatment from a hot rolled coil having a thickness of as low as 1.2 mm and as high as 12.7 mm which comprises uncoiling the hot rolled coil, heating said uncoiled strip from a temperature of the $A_1$ point to temperatures below 1300° C to make the matrix (structure) of the strip uniform and strong by utilizing the phase deformation of matrix of the strip, subjecting the same to a forced cooling down to temperatures below the $A_1$ point at a cooling rate of at least 20° C/min., and positively imparting a stress upon said strip during the heat treatment to make the matrix of the strip fine and uniform.

3. A method for the manufacture of a steel sheet, steel strip and the like subjected to a heat treatment from a hot rolled coil having a thickness of as low as 1.2 mm and as high as 12.7 mm which comprises uncoiling the hot rolled coil, heating said uncoiled strip from a temperature of the $A_1$ point to temperatures below 1300° C to make the matrix of the strip uniform and strong by utilizng the phase deformation of the matrix of the strip, subjecting the same to a forced cooling down to temperatures below the $A_1$ point at a cooling rate of at least 20° C/min., reheating the strip at temperatures below 1000° C, and positively imparting a stress upon the strip during the heat treatment to make the matrix of the strip fine and uniform.

4. A method for the manufacture of a steel sheet, steel strip and the like subjected to a heat treatment from a hot rolled coil having a thickness of as low as 1.2 mm and as high as 12.7 mm which comprises uncoiling the hot rolled coil, heating said uncoiled strip from a temperature of the $A_1$ point to temperatures below 1300° C to make the matrix of the strip uniform and strong by utilizing the phase deformation of matrix of the strip, rolling the strip at temperatures above the $A_1$ point at a reduction of at least 3% to make the steel strong, tough and ductile, subjecting the same to a forced cooling rate of at least 20° C/min., and positively imparting a stress upon the strip during the heat treatment to make the matrix of the strip fine and uniform.

5. A method for the manufacture of a steel sheet, steel strip and the like subjected to heat treatment from a hot rolled coil having a thickness of as low as 1.2 mm and as high as 12.7 mm which comprises uncoiling the hot rolled coil, heating said uncoiled strip at a temperature below the $A_3$ point, rolling the strip at temperatures between 200° C and 750° C at a reduction of at least 3% to produce precipitation suitable for obtaining good deep-drawability after cold rolling and annealing, subjecting the same to a forced cooling down to temperatures below the $A_1$ point at a cooling rate of at least 20° C/min., and positively imparting a stress upon the strip during the heat treatment to promote deep-drawability.

6. A method for the manufacture of a steel sheet, steel strip and the like subjected to a heat treatment from a hot rolled coil having a thickness of as low as 1.2 mm and as high as 12.7 mm which comprises uncoiling and the hot rolled coil, heating said uncoiled strip from a temperature of the $A_1$ point to temperatures below 1300° C to make the matrix of the strip uniform and strong by utilizing the phase deformation of matrix of the strip, rolling the strip at temperatures above the $A_1$ point at a reduction of at least 3% to make the steel strong, tough and ductile, subjecting the same to a forced cooling down to temperatures below the $A_1$ point at a cooling rate of at least 20° C/min., reheating the strip at temperatures below 1000° C, and positively imparting a stress upon said strip during the heat treatment to make the matrix of the strip fine and uniform.

7. A method for the manufacture of a steel sheet, steel strip and the like subjected to a heat treatment from a hot rolled coil having a thickness of as low as 1.2 mm and as high as 12.7 mm which comprises uncoiling the hot rolled coil, heating said uncoiled strip at temperatures below the $A_3$ point, rolling the strip at temperatures between 200° C and 750° C at a reduction of at least 15% to produce a desirable recrystallization texture for deep-drawability, subjecting the same to a forced cooling down to temperatures below the $A_1$ point at a cooling rate of at least 20° C/min., reheating the strip at temperatures below the $A_3$ point, and positively imparting a stress upon the strip during the heat treatment to promote deep-drawability.

8. A method according to claim 1 in which the stress imparted is at least 1.0Kg/mm².

9. A method according to claim 2 in which the stress imparted is at least 1.0Kg/mm².

10. A method according to claim 3 in which the stress imparted is at least 1.0Kg/mm².

11. A method according to claim 4 in which the stress imparted is 1.0Kg/mm².

12. A method according to claim 5 in which the stress imparted is at least 1.0Kg/mm².

13. A method according to claim 6 in which the stress imparted is at least 1.0Kg/mm².

14. A method according to claim 7 in which the stress imparted is at least 1.0Kg/mm².

15. An apparatus for the manufacture of a steel sheet, steel strip and the like subjected to a heat treatment from a hot rolled coil which comprises an uncoiler, a non-oxidizing heating furnace, steel strip transport roll means, forced cooling means for directing a cooling medium against said steel strip at locations between succeeding transport roll means, a second heating furnace, and a stress-imparting means, said stress-imparting means being selectively positioned at a location between said uncoiler and the outlet of the second heating furnace, all the aforementioned elements being arranged in line.

16. An apparatus according to claim 15 in which at least one rolling stand is arranged between the non-oxidizing heating furnace and the forced cooling means.

* * * * *